US005158019A

United States Patent [19]

Miescher et al.

[11] Patent Number: 5,158,019

[45] Date of Patent: Oct. 27, 1992

[54] DEVICE FOR INFINITELY VARIABLE ADJUSTMENT OF THE AXIAL SPREADING MOVEMENT OF DISTRIBUTING ROLLERS

[75] Inventors: Andreas Miescher, Ittigen; Max Egger, Thun, both of Switzerland

[73] Assignee: Maschinenfabrik Wifag, Bern, Switzerland

[21] Appl. No.: 776,080

[22] Filed: Oct. 11, 1991

[30] Foreign Application Priority Data

Oct. 12, 1990 [DE] Fed. Rep. of Germany ..... 4032470

[51] Int. Cl.[5] ..... B41F 31/14; B41L 27/16

[52] U.S. Cl. ..... 101/349; 101/DIG. 38

[58] Field of Search ..... 101/349, 348, 350, 351, 101/352, 148, DIG. 38, 354, 355, 302, 304, 305, 323, 325, 307-309, 311-314; 74/22 A, 84 R

[56] References Cited

U.S. PATENT DOCUMENTS 897,152 8/1908 Rockstroh ..... 101/DIG. 38
4,428,290 1/1984 Junghans ..... 101/DIG. 38
5,003,874 4/1991 Junghans ..... 101/348

*Primary Examiner*—J. Reed Fisher
*Attorney, Agent, or Firm*—McGlew & Tuttle

[57] ABSTRACT

To adjust the axial spreading movement of distributing rollers (30) in rotary printing presses, at least one eccentric stud (18) is mounted which is rotatable around its axis of rotation (19) in a rotatably drivable housing (3). The housing rotates around the axis of rotation (9) which is located at a distance (a) from the axis of rotation of the eccentric stud. The eccentric stud (18) has an eccentric pin (20), which is arranged at least at one of its ends and is located at the same distance (a) from the axis of rotation (19) of the eccentric stud (18). The eccentric stud (18) is rotatable via a sleeve (10) and via the planetary gear (16), i.e., the distance of the eccentric pin (20) from the axis of rotation (9) can be changed. The eccentric pin (20) transforms its rotary movement via a sliding block (29) into a reciprocating movement, with which the distributing roller (30) is axially driven.

14 Claims, 8 Drawing Sheets

DEVICE FOR INFINITELY VARIABLE ADJUSTMENT OF THE AXIAL SPREADING MOVEMENT OF DISTRIBUTING ROLLERS

FIELD OF THE INVENTION

The present invention pertains to a device on rotary printing presses for infinitely variably adjusting the axial spreading movement of distributing rollers of inking and dampening systems in rotary printing presses and more particularly to a body of revolution driven by a press drive with a coaxial eccentric pin arranged on the body of revolution and with a device for adjusting the distance between the eccentric pin and the axis of rotation of the body of revolution and with means for transforming the rotary movement of the eccentric pin into reciprocating movement and to transmit this reciprocating movement to the distributing rollers.

BACKGROUND OF THE INVENTION

Devices of this class have been know. For example, such a device, in which an eccentric pin is displacably arranged on a body of revolution, is disclosed in West German Patent Specification No. DE-PS 38,14,927. The displacement of the eccentric pin takes place along a groove that extends at right angles to the axis of rotation of the body of revolution and through its center. A sliding block, which is connected to the eccentric pin by means of a locking screw, is slidably inserted into the groove. To adjust the distance between the eccentric pin and the axis of rotation of the body of revolution, the locking screw must be loosened, as a result of which the eccentric pin can be displaced into the desired position along the groove. The locking screw must then again be tightened, and the eccentric pin is thus again firmly connected to the body of revolution.

Even though infinitely variable adjustment of the axial displacement of the distributing rollers can be performed with this device, it is necessary to uncouple at least the drive of the body of revolution from the press drive for each adjustment process in order to stop the rotary movement of the body of revolution. Consequently, it is impossible to adjust the axial displacement of the distributing rollers during the production process with the above- described device. Consequently, the adjustment of the axial displacement requires a complicated intervention with the lifting drive. Automatic adjustment or adjustment from outside the press is not possible with this device.

Another device for adjusting the axial displacement for achieving reciprocating movement of distributing rollers is disclosed in West German Offenlegungsschrift No. DE-OS 25,14,414. A rocker arm, which can be deflected from its null position via an adjusting device, is pivotably mounted in a body of revolution. A pivot pin is fastened at its end facing away from the adjusting device. A lever, which transmits the movement to the distributing rollers via deflecting levers in the form of a reciprocating movement, is hinged to this pivot pin. Due to the rocker arm being deflected from its null position, the pivot pin is moved away to a distance from the axis of rotation of the body of revolution and is thus brought into an eccentric position.

Even though this device makes it possible to adjust the axial displacement for the reciprocating movement of the distributing rollers during the operation of the press, it might be difficult to achieve greater stroke movements as a consequence of the forces occurring as a result of load changes.

It is also desirable not only to distribute the ink by such reciprocating movement of distributing rollers during the production process, but also to use these axial displacements even during the automatic washing of the rollers of the inking and dampening system. As is known, it is possible to print with different inks over the width of the web to be printed on in printing presses that are able to print several pages side by side. To prevent two different inks of adjacent print zones from being distributed into one another and mixed with one another during the distribution by the distributing rollers, the inking rollers have recesses at the edge zones of the pages. During the printing process, the axial spreading movement of the inking rollers is smaller than the width of the recesses of the inking rollers in order to prevent a different ink from being transferred by the distributing rollers from one zone to the other. Ink will, of course, accumulate in the recesses and on the areas of the distributing roller which never extend beyond the recesses of the inking rollers during production, and this ink must be washed off at the time of a change from one ink to another or when the production is changed. In order to automatically clean the distributing rollers and the inking rollers by washing, it is necessary for the axial displacement of the reciprocating movement to be able to be increased such that it will be greater than the width of the recesses on the inking roller. In this way all the ink residues that have collected on the distributing rollers an be stripped off. To guarantee efficient automatic washing, it must be possible to adjust the axial displacement of the distributing roller even to the size of the washing stroke in a very simple manner.

SUMMARY AND OBJECTS OF THE INVENTION

These additional requirements on the adjusting device adjusting the axial displacement of distributing rollers cannot be met with either of the two above-described devices. The task of the present invention is to provide a device with which it is possible to adjust the axial spreading movement of distributing rollers for inking and dampening systems in an infinitely variable manner during the operation of the press manually or automatically such that the adjustable maximum movement that is used for the automatic washing of the rollers of the inking and dampening systems is greater than the greatest displacement required for distribution during the production process, as a result of which efficient washing of the rollers can be achieved when changing over the production.

According to the invention, a device is provided for infinitely variably adjusting the axial spreading movement of distributing rollers in rotary printing presses. The device includes a rotatably mounted driveable housing and at least one eccentric stud mounted in the driveable housing, axially in parallel with the axis of rotation of the driveable housing. An eccentric pin is arranged at least at one end of the eccentric stud having a central axis spaced a distance from a central axis of the eccentric stud. The axis of the eccentric stud is located at the same distance A from the axis of rotation of the drivable housing. The eccentric stud is rotatable around its central axis through an angle via an adjusting device which may be operated from outside of the drivable housing. The eccentric pin is positionable in two extreme positions including one extreme position of a range of adjustment in which the axis of the eccentric pin coincides with the axis of the rotatably drivable housing and another extreme position of the range of adjustment in which the axis of the eccentric pin is located at a distance corresponding to a maximum stroke from the axis of the rotatable drivable housing.

The adjustment of the eccentric pin by rotating the eccentric stud is advantageously carried out via a sleeve provided with internal teeth and external helical teeth. This sleeve is mounted coaxially rotatably on the rotating housing. The rotation of this sleeve in relation to the housing is brought about simply by displacing a gear which likewise has helical teeth and is arranged outside the housing on a shaft parallel to the axis of rotation of the housing. This helical gear is nonrotatably but displacably connected via a gear that engages teeth arranged on the housing, as a result of which the helical gear does not change its rotation position in relation to the housing. By displacing this helical gear along the helical teeth of the sleeve, the sleeve will be rotated relative to the housing. This rotary movement is transmitted to the eccentric stud via another gear arranged in the housing as a planetary gear, as a result of which the eccentric stud will be rotated.

The displacement of this helical gear is advantageously carried out by means of a piston that can be actuated pneumatically. The end position of the piston, which is predetermined by a fixed stop, is the same as the wash stroke position of the eccentric pin. The stroke is adjusted by displacement of the piston that can be actuated pneumatically away from the maximum stroke position toward an adjustable stop. This stop can be adjusted manually or automatically in the known manner.

According to another advantageous embodiment of the present invention, two eccentric studs, which have equal or different distances from the axis of rotation of the housing, are arranged in the housing. It is achieved with this arrangement that one eccentric pin, from which one movement each for the axial reciprocating movements of two distributing rollers can be obtained, is available on both sides of the housing. The axial stroke movement of these two distributing rollers is different in the case of different distances between the eccentric studs and the axis of rotation of the housing because of the different eccentricities of the eccentric pins. In order for the axial stroke movements of the two distributing rollers not to take place in phase, the two eccentric pins are phase-shifted by 90° relative to one another.

Load changes occur at the reversal points in such eccentric drives. In the adjusting device according to the present invention, these load changes and the associated impact stresses shall be prevented from having to be absorbed by the teeth of the adjusting members. The two eccentric studs are therefore provided on their outside with a conical support surface which forms slide bearings with correspondingly shaped bearing shells. Both eccentric pins are pressed into the corresponding conical slide bearings by spring force. The angle of the cone of the slide bearing is adjusted to the spring force by which with the pins are pushed into the corresponding slide bearings such that the load changes which occur during the drive for the stroke movements of the distributing rollers are not transmitted by the adhesion of the conical sliding surfaces to the gears, but the static friction can be overcome during the adjustment of the eccentric stud without exerting excessive force, and the eccentric studs can be rotated.

The housing with the integrated eccentric pin or pins is advantageously mounted in the printing press such that the axis of rotation of the housing is at right angles to the axes of rotation of the distributing rollers. As a result, the respective eccentric pin is able to directly engage a sliding block that is arranged on the shaft of the distributing roller in the known manner. If the housing is provided with two eccentric studs, it can thus be placed between two distributing roller shafts such that two distributing rollers can simultaneously be moved axially to and from by the eccentric pins arranged on both sides, without the need for additional elements for transmitting the movement. A simple and compact design is thus achieved.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
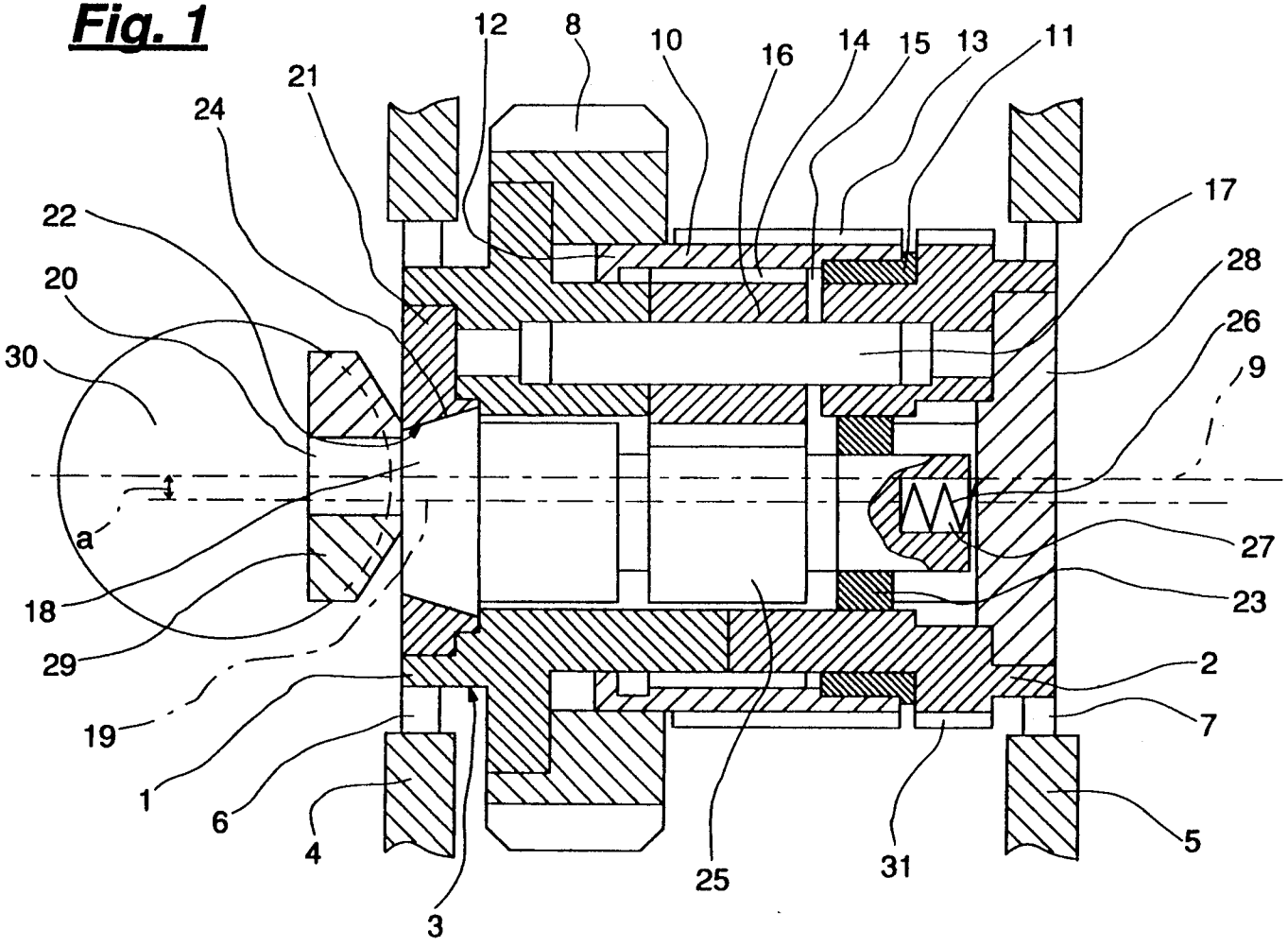
FIG. 1 is a longitudinal sectional view taken through the rotatably drivable housing with one eccentric stud according to the invention.
Figure 2:
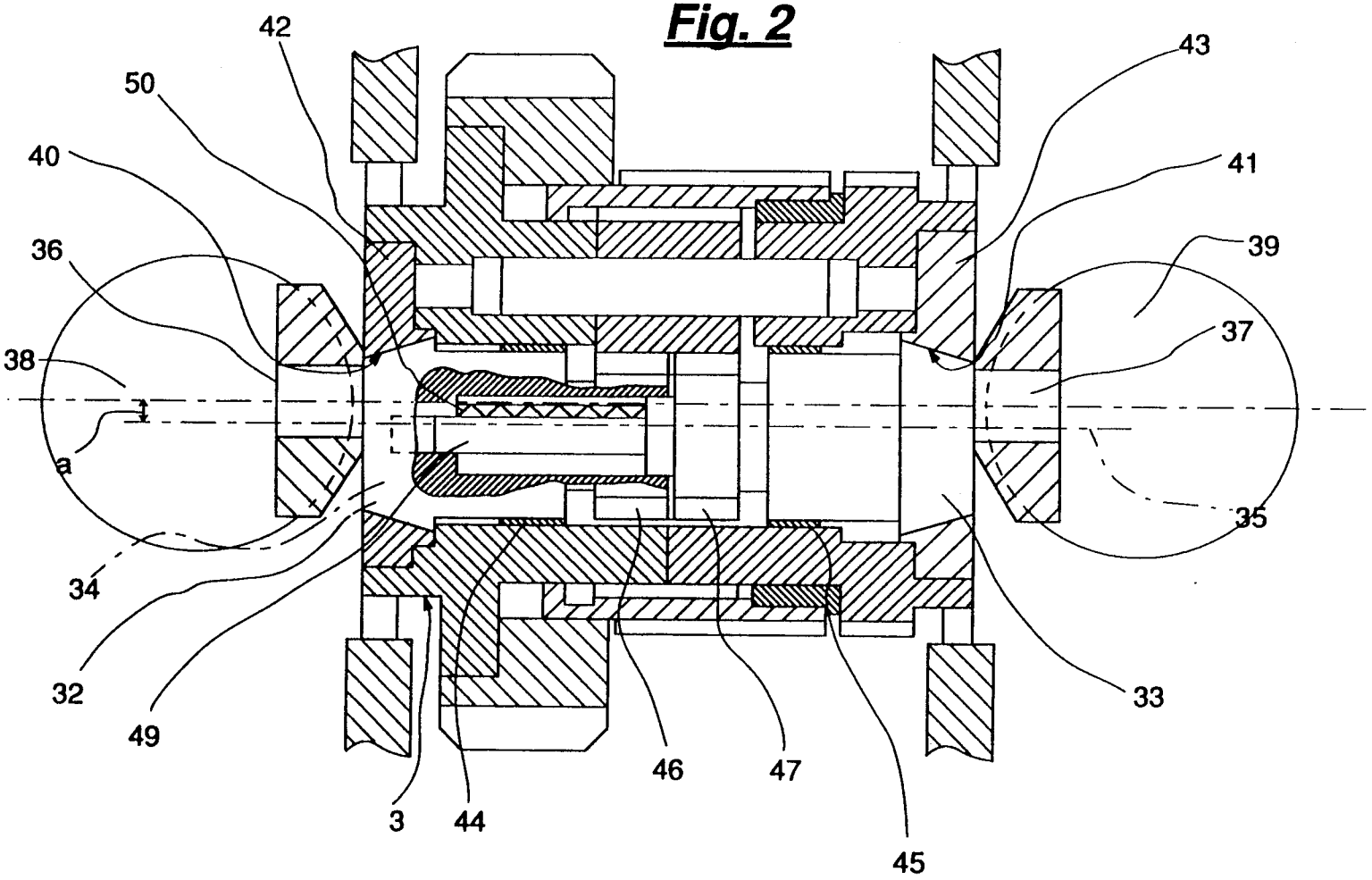
FIG. 2 is a longitudinal sectional view taken through the rotatably drivable housing with two eccentric studs according to the invention.

According FIGS. 1 and 2, part 1 and part 2 which are permanently connected to one another, form the rotatably drivable housing 3. The rotatably drivable housing 3 is rotatably mounted in supports 4 and 5, which are permanently connected to the printing press, by means of bearings 6 and 7. A gear 8 is nonrotatably connected to the rotatably drivable hosing 3. The gear 8 engages a drive gear (not show), which is driven by the press drive, as a result of which the rotatably drivable housing is set to rotation around the axis of rotation 9. The rotatably drivable housing 3 is surrounded by a coaxially arranged sleeve 10. The sleeve 10 is mounted rotatably relative to the rotatably drivable housing 3 in a bearing 11 or support surface 12. The sleeve 10 has helical teeth 13 on its outside and straight teeth 14 on its inside. A recess 15, which leaves space for a planetary gear 16, is provided in the rotatably drivable housing 3. The planetary gear 16 is seated freely rotatably on a shaft 17. The shaft 17 is permanently arranged in the rotatably drivable housing 3 in parallel to the axis of rotation 9. The planetary gear 16 engages the internal straight teeth 14 of the sleeve 10.

An eccentric stud 18 is rotatably mounted in the rotatably drivable housing 3 such that its axis is parallel to the axis of rotation 9. The axis 19 of the eccentric stud 18, around which the eccentric stud 18 rotates, is located at a distance from the axis of rotation 9 of the rotatably drivable housing 3. The eccentric stud 18 is provided, on one of its sides, with an axially parallel eccentric pin 20, which is located at a distance a from the axis of rotation 19 of the eccentric stud 18. The eccentric pin 20 extends beyond the cover 21 closing the housing 3. It engages a sliding block 29, which transforms the rotary movement of the eccentric pin 20 into a reciprocating movement, which serves as the spreading movement of the distributing roller 30. On the side of the eccentric pin 20, the eccentric stud 18 is provided with a conical sliding surface 22, which forms a bearing 24 together with an opening of corresponding shape provided in the cover 21. The end of the eccentric stud 18 opposite the eccentric pin 20 is mounted in a radial bearing 23. Between the bearing 24 and the radial bearing 23, the eccentric stud 18 is provided with teeth 25 which engage the planetary gear 16. The eccentric stud 18 is pressed into the conical bearing 24 by a spring 26, which is placed into an opening 27 of the eccentric stud 18 and is supported on the cover 28, which closes the rotatably drivable housing 3 at its rear end. The spring force and the cone angle of the bearing 24 are adjusted to one another such that the eccentric stud 18 is rotatable for adjusting the spreading movement, but the load changes which are generated by the reciprocating movement of the distributing roller are not transmitted to the teeth 25 and the planetary gear 16.

The distance between the eccentric pin 18 and the axis of rotation 9 of the rotatably drivable housing 3 and consequently the stroke of the spreading movement of the distributing roller are adjusted by rotating the eccentric stud 18 in relation to the rotatably drivable housing 3. This rotation of the eccentric stud 18 is brought about, in a clearly visible manner, by rotating the sleeve 10 in relation to the rotatably drivable housing 3, as a result of which this rotary movement is transmitted via the planetary gear 16 to the eccentric stud 18. Immediately next to the sleeve 10, the rotatably drivable housing 3 has teeth 31, which are arranged coaxially to the axis of rotation 9 and have the same effective diameter as the helical teeth 13 of the sleeve 10.

According to FIG. 2, the rotatably drivable housing 3 has the same design as that described in FIG. 1. The difference is that two eccentric studs 32 and 33, respectively, are rotatably mounted such that their axes are parallel to the axis of rotation 9 of the rotatably drivable housing 3. The first eccentric stud 32 and the second eccentric stud 33 are nearly in contact with one another with their end faces centrally in the rotatably drivable housing 3, leaving a small intermediate space between them. The axis of rotation 34 of the first eccentric stud 32 and the axis of rotation of the second eccentric stud 33 may be located at rotation 9 of the rotatably drivable housing 3 (cf. FIG. 7) different distances a and b, respectively, from the axis of Both of the eccentric studs 32 and 33 are provided at their outer ends with an eccentric pin 36 and 37, respectively, which cause the corresponding distributing rollers 38 and 39, respectively, to perform axial reciprocating movements in the described manner. On the eccentric pin side, both of the eccentric studs 32 and 33 can be seen with conical slide bearing surfaces 40 and 41, respectively, which are rotatably supported in corresponding openings of the covers 42 and 43, respectively, which close the rotatably drivable housing 3 on both sides. Each of the eccentric studs 32 and 33 is held with an additional radial bearing 44 and 45, respectively. At their adjacent ends, both of the eccentric studs 32 and 33 are provided with teeth 46 and 47, respectively, both of which engage the planetary gear 16. By rotating the sleeve 10, the two eccentric studs 32 and 33 are rotated together via the planetary gear 16. A spring stud 49, which is pressed by a spring 50 against the end face of the second eccentric stud 33, is displacably introduced into an opening of the first eccentric stud 32. The spring stud 49 causes both the first eccentric stud 32 and the second eccentric stud 33 to be pressed against the corresponding conical slide bearing surface 40 and 41, respectively. The force of the spring 50 and the cone angle of the two slide bearing surfaces 40 and 41, respectively, are adjusted to one another such that the eccentric studs 32 and 33, respectively, can be rotated to adjust the spreading strokes of the two distributing rollers 38 and 39, respectively, but the load changes which are brought about by the reciprocating movement of the distributing rollers 38 and 39, respectively, will not be transmitted to the teeth of the adjusting device.

Figure 3:
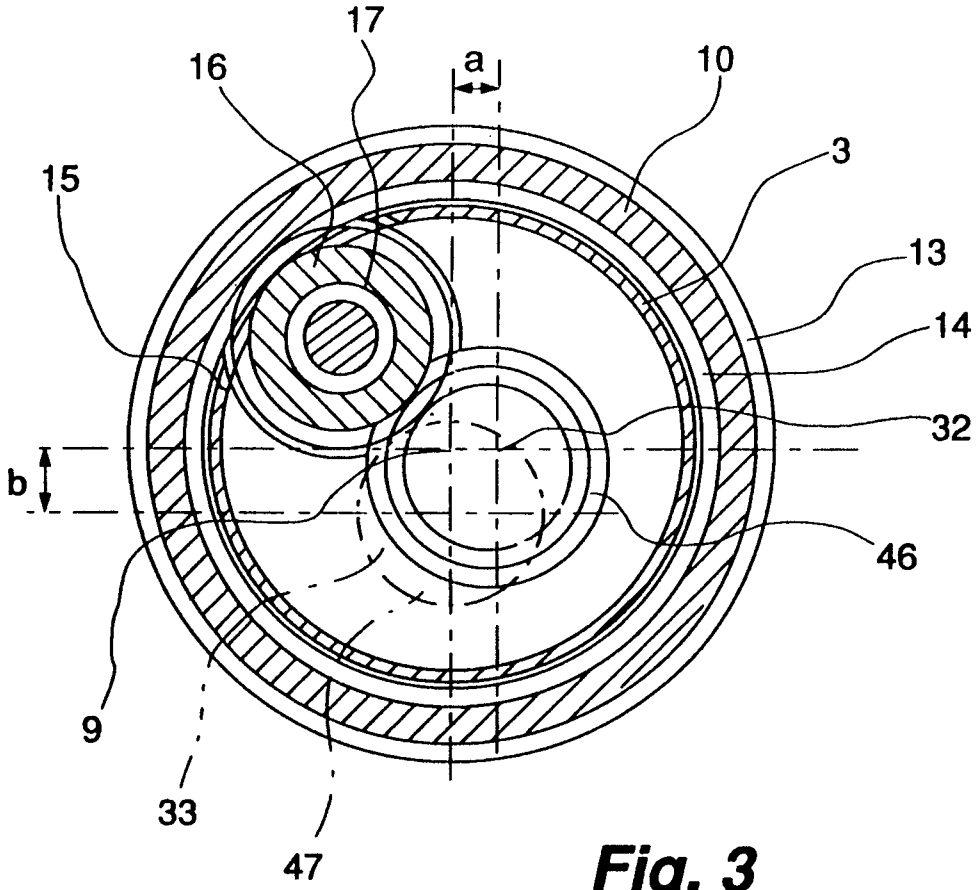
FIG. 3 is a cross sectional view taken through the rotatably drivable housing along the line III—III according to FIGS. 1 and 2.

According to FIG. 3, the rotatably drivable housing 3 has a recess 15, in which the planetary gear 16 is arranged. The planetary gear 16 is freely rotatable around the axis 17, which is permanently connected to the rotatably drivable housing 3. The sleeve 10 is rotatably mounted around the rotatably drivable housing 3. The sleeve 10 has helical teeth 13 on the outside, while the internal straight teeth 14 engage the planetary gear 16. The rotatably drivable housing 3 and the sleeve 10 have a common axis of rotation 9. The first eccentric stud 32 is rotatably mounted at a distance a from the axis of rotation 9, while the second eccentric stud 33 is located at a distance a from the axis of rotation 9. Both the teeth 46 of the first eccentric stud 32 and the teeth 47 of the second eccentric stud 33 engage the planetary gear 16 and are consequently located at equal distance from the axis 17 of the planetary gear 16.

Figure 4:
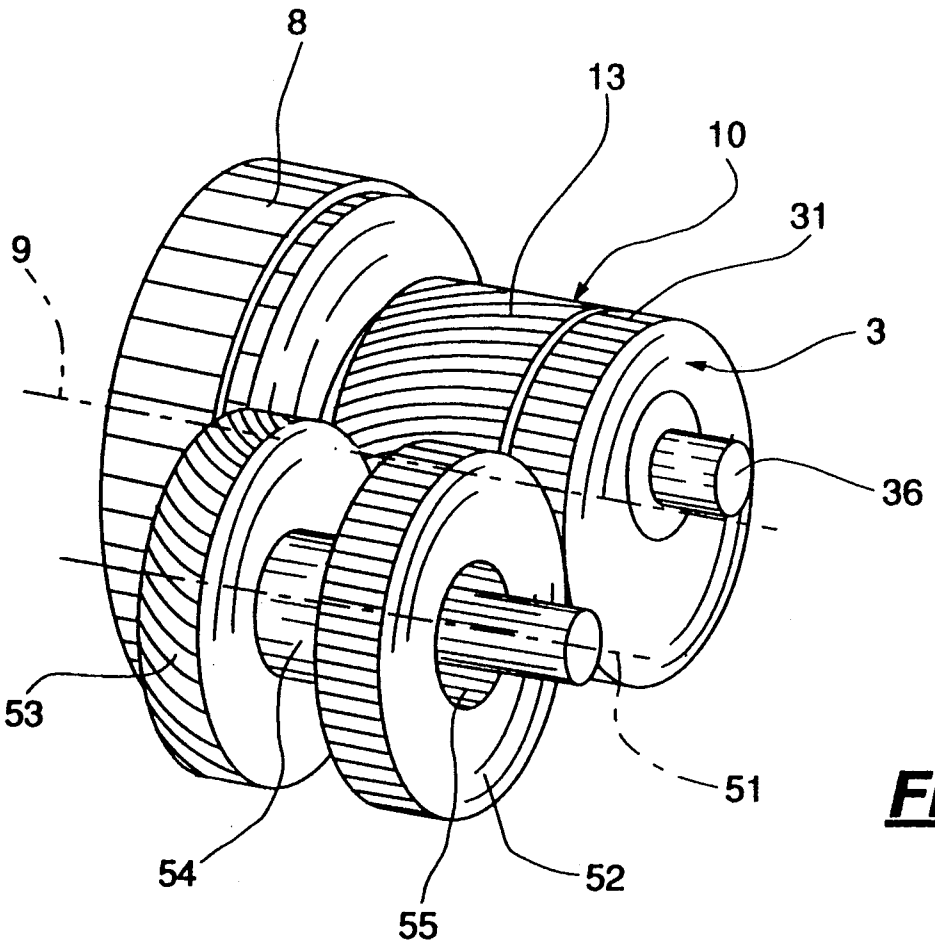
FIG. 4 is a three-dimensional representation of the adjusting device in the washing stroke position.
Figure 5:
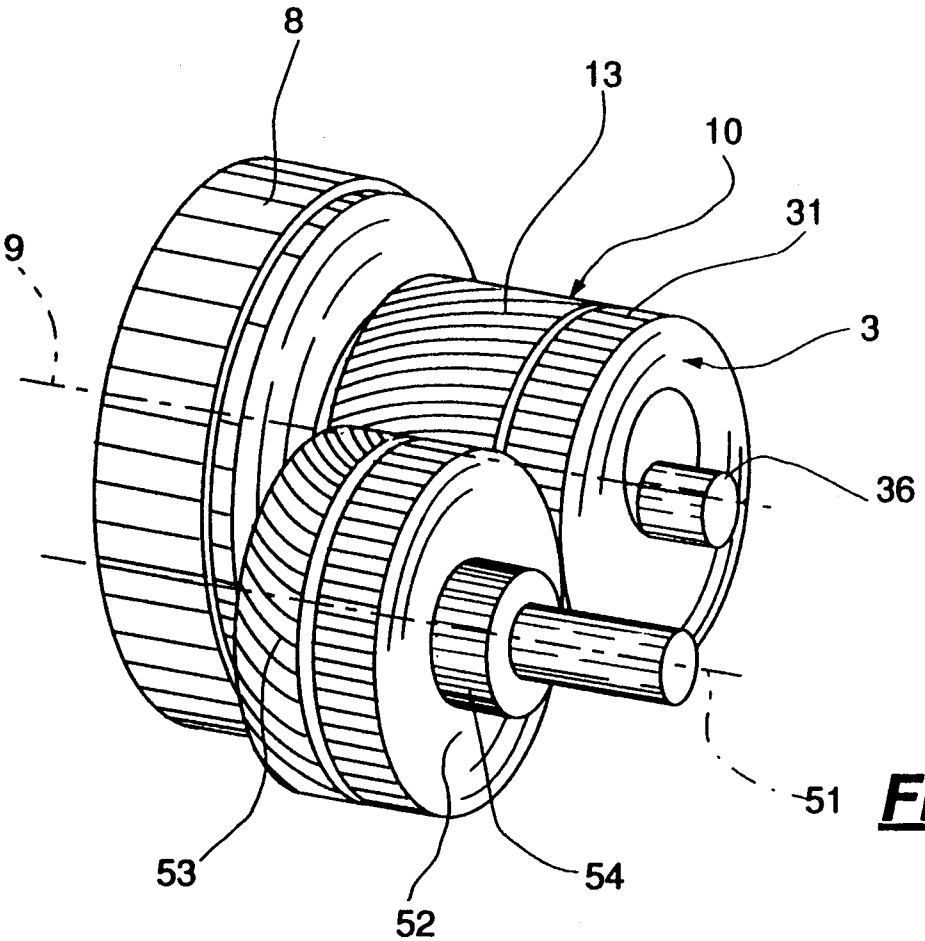
FIG. 5 is a perspective view of the adjusting device according to the invention, in which the eccentric stud is in the null position.

FIGS. 4 and 5 show in a perspective representation, how the rotation of the sleeve 10 takes place in relation to the rotatably drivable housing 3. A spur gear 52 with straight teeth, which permanently engages the teeth 31 of the rotatably drivable housing 3, is arranged on a shaft 51 represented schematically, which is arranged in parallel to the axis of rotation 9 of the rotatably drivable housing 3, but outside the housing. An adjusting gear 53 with helical teeth, which permanently engages the helical teeth 13 of the sleeve 10, is seated on the same shaft 51 represented schematically. The adjusting gear 53 is displacable on the shaft 51 represented schematically in relation to the spur gear 52, but it maintains its rotation position relative to the spur gear 52. This is achieved by the adjusting gear 53 having a bushing 54, which is profiled in the longitudinal direction and can be pushed into a correspondingly shaped opening 55 of the spur gear 52.

The rotatably drivable housing 3 is set to rotation by the drive of the press via the gear 8. The spur gear 52 engaging the teeth 31 of the rotatably drivable housing and the adjusting gear 53 are also set to rotation. The adjusting gear 53 transmits the rotary movement to the sleeve 10 via the helical teeth 13. Since the teeth 31 and the helical teeth 13 of the sleeve 10, on the one hand, and the adjusting gear 53 and the spur gear 52, on the other hand, have the same effective diameter, the rotatably drivable housing 3 and the sleeve 10 are not moving relative to one another. To make it now possible to rotate the sleeve 10 in relation to the rotatably drivable housing 3, the adjusting gear 53 is displaced in the longitudinal direction of the shaft 51 represented schematically. The helical teeth of the adjusting gear 53 and the helical teeth 13 of the sleeve 10 bring about rotation of the sleeve 10. This adjustment process can be performed both during the rotation of the rotatably drivable housing 3 and after it has stopped. FIG. 4 shows the adjusting gear 53 in a position in which it has been moved to the left. In this position, the eccentric pin 36 has its maximum distance from the axis of rotation 9 of the rotatably drivable housing 3. This means that the reciprocating movement transmitted to the distributing roller has its maximum and corresponds to the washing stroke.

FIG. 5 shows the situation in which the adjusting gear has been displaced into the withdrawn position. The eccentric stud 32 is rotated so far that the eccentric pin 36 drops with its central axis into the axis of rotation 9 of the rotatably drivable housing. No reciprocating movement can be transmitted to the distributing roller in this null position.

Figure 6:
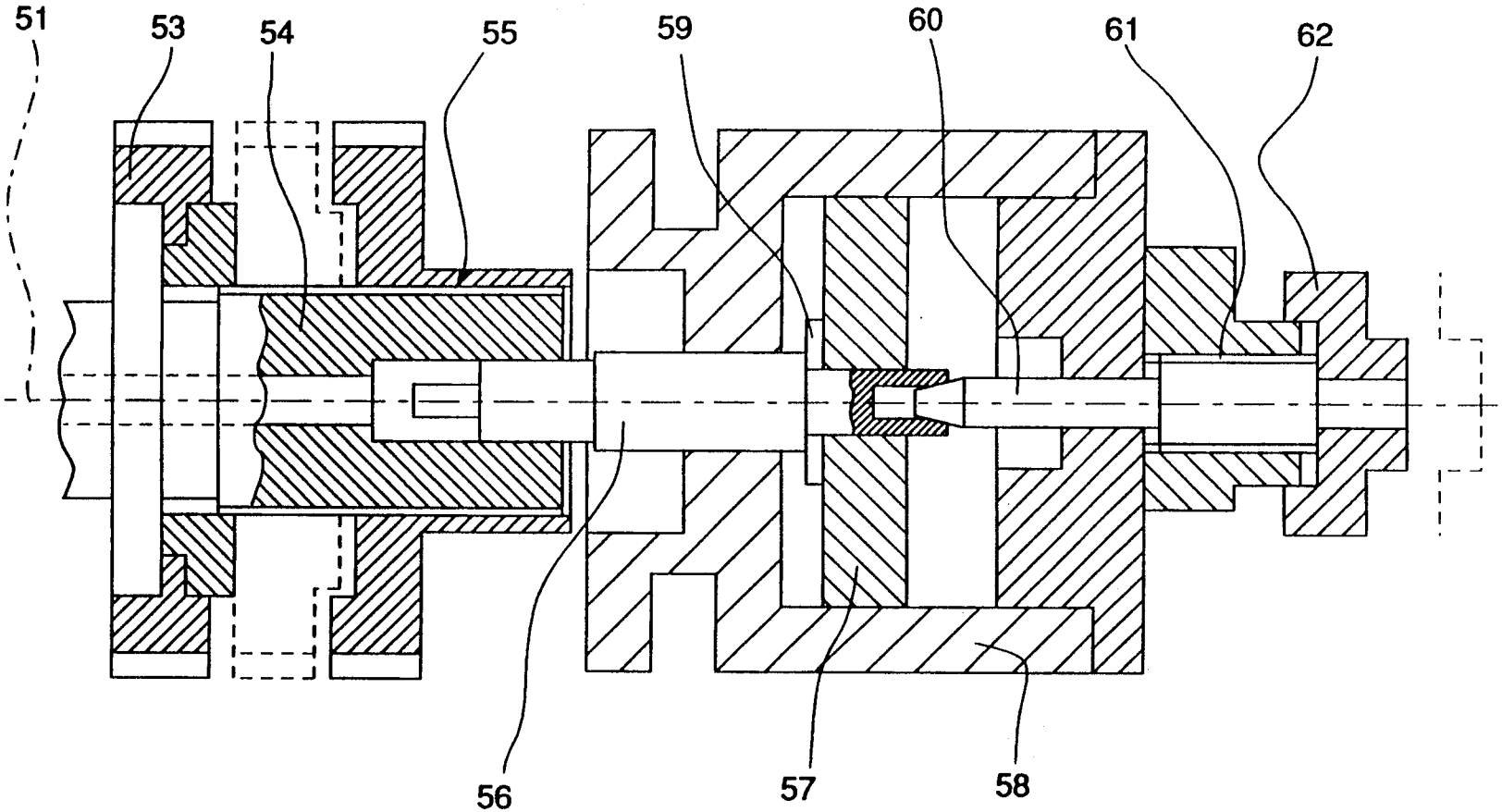
FIG. 6 is a longitudinal sectional view taken through the device for axially displacing the helical gear.

FIG. 6 shows the adjusting device for displacing the adjusting gear 3. As was mentioned above, the adjusting gear 53 is equipped with a bushing 54, whose surface is profiled in the longitudinal direction. The bushing 54 can be pushed into a correspondingly designed opening 55 of the spur gear 52, which gear is stationary. Both the spur gear 52 and the adjusting gear 53 are rotatable around the axis 51. The bushing 54 is permanently connected to a piston rod 56. Together with a piston 57 and a cylinder housing 58, the piston rod 56 forms one unit which has the function of a pneumatic cylinder. The piston rod 56 is subdivided into two parts which are coupled with a bearing in the known manner, so that the rotary movement of the spur gear 52 and of the adjusting gear 53 will not be transmitted to the piston 57, whereas the pushing movement of the piston 57 must be transmitted to the bushing 54 of the adjusting gear 53. The left end position of the adjusting gear 53 is fixed by the fixed stop 59 of the piston 57. This position means that the reciprocating movement of the distributing roller becomes maximal and correspond to the washing stroke. To adjust the working stroke of the distributing roller, which is smaller than the washing stroke, a pressure medium is admitted to the piston 57 from the other side, and will move toward an adjustable stop 60. The adjustable stop 60 is provided with a threaded section 61, so that by rotating the adjustable stop 60, its location can be changed as a consequence of the threaded section 61. The rotation of the adjustable stop 60 is transmitted to the pinion 62 via a toothed belt drive (not shown).

Figure 7:
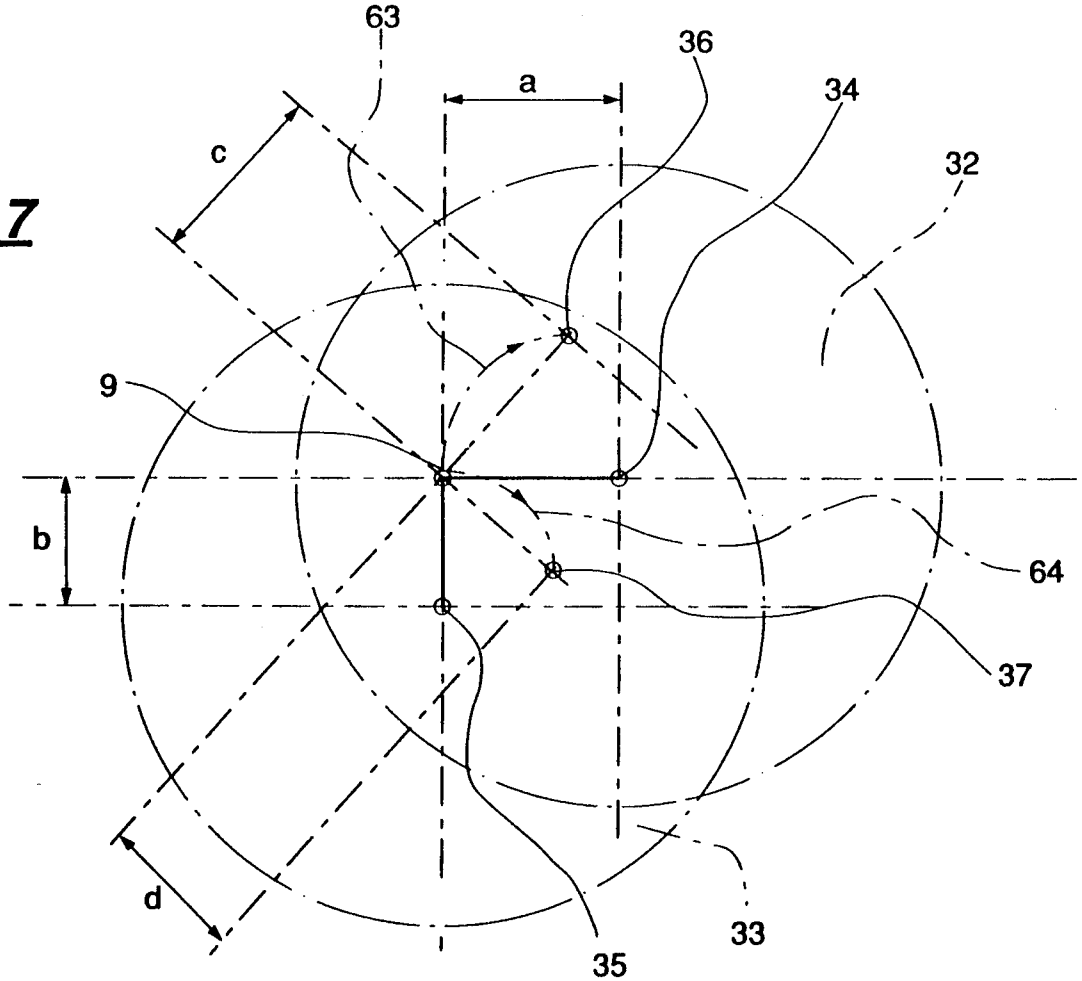
FIG. 7 is a representation of the geometric arrangement of the eccentric pin and the eccentric studs in relation to the axis of rotation of the housing.

FIG. 7 schematically shows the arrangement of the first eccentric stud 32 and the second eccentric stud 33 in relation to the axis of rotation 9 of the rotatably drivable housing 3. The axis of rotation 34 of the first eccentric stud 32 is located at a distance a from the axis of rotation 9. The eccentric pin 36 is located at the same distance a from the axis of rotation 34 of the eccentric stud 32. On rotating the eccentric stud 32, the center of the eccentric pin 36 will move along the circular arc 63. In the null position, the center of the eccentric pin 36 coincides with the axis of rotation 9. In the washing stroke position, the center of the eccentric pin 36 is located at a distance c from the axis of rotation 9. The second eccentric stud 33 is arranged at a distance b from the axis of rotation 9 at right angles to the distance a. The center of the eccentric pin 37 is located at the same distance from the axis of rotation 35 of the second eccentric stud 33. Thus, the center of the eccentric pin 37 coincides with the axis of rotation 9 in the null position. On rotating the eccentric stud 33, the center of the eccentric pin 37 will move along the circular arc 64. At maximum rotation of the eccentric stud 33, aid eccentric pin 37 is located at the distance d from the axis of rotation 9.

The right angle between the distance a of the eccentric stud 32 and the distance b of the eccentric stud 33 from the axis of rotation 9 was selected such that the spreading movement of two distributing rollers simultaneously performing reciprocating movement is not in phase.

Figure 8:
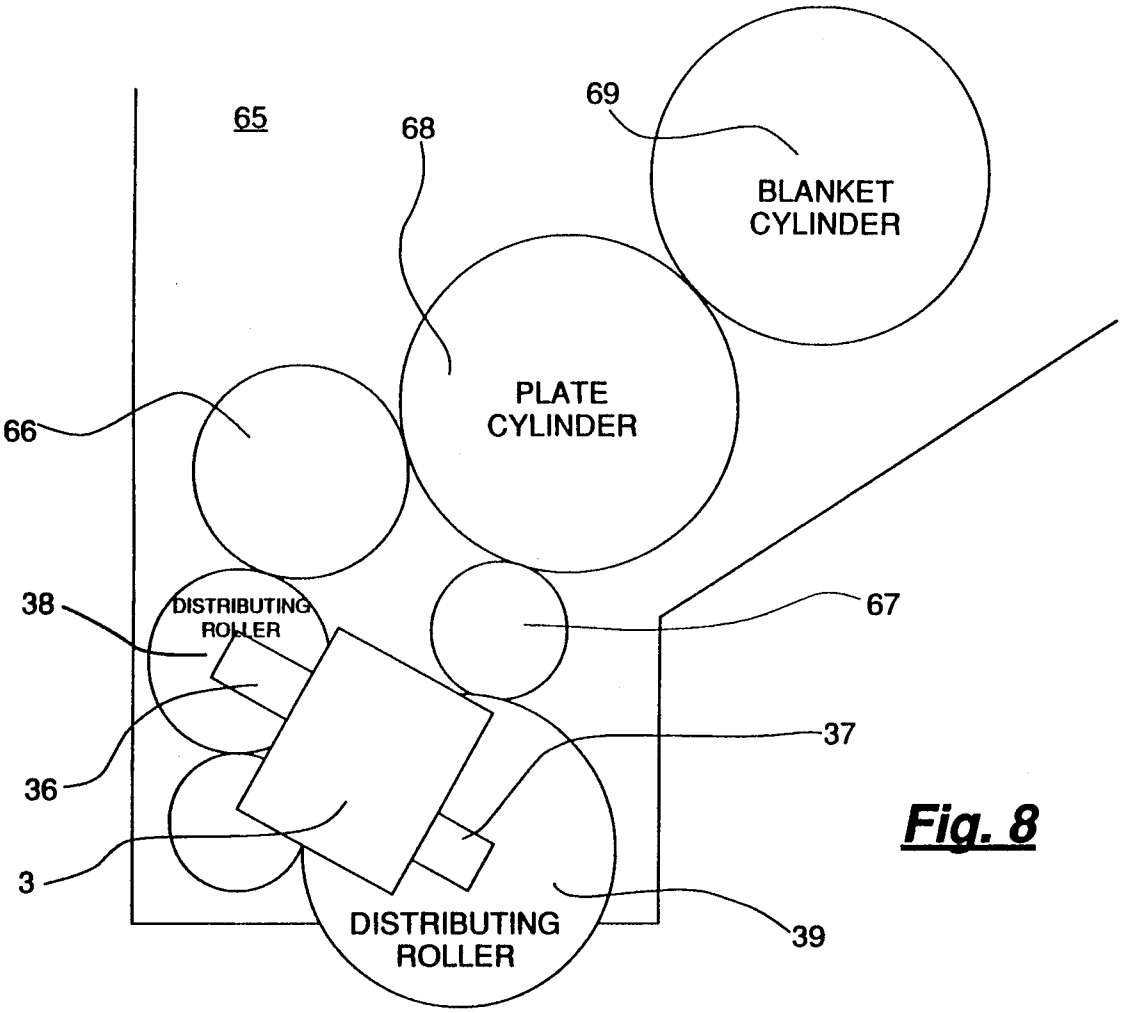
FIG. 8 is a schematic view showing the arrangement of the drive mechanism for the spreading movement of the distributing rollers in a printing press.

FIG. 8 shows schematically the placement of such a rotatably drivable housing 3 with the two eccentric pins 36 and 37 between two distributing rollers 38 and 39 of a printing press 65. The ink or dampening agent is transferred from the distributing rollers 38 and 39 to the plate cylinder 68 via inking rollers 66 and 67. From there, the printed image is transferred to the printing carrier (not shown) via the blanket cylinder 69.

While specific embodiments of the invention have been shown and described in detail to illustrate the application of the principles of the invention, it will be understood that the invention may be embodied otherwise without departing from such principles.

What is claimed is:

1. A device for infinitely variably adjusting an axial spreading movement of distributing rollers in rotary printing presses, the device comprising a fixed rotatably drivable housing; an eccentric stud, mounted in said rotatably drivable housing having an axis of rotation parallel with an axis of rotation of said rotatably drivable housing; an eccentric pin arrangement at least at one end of said eccentric stud and having a central axis spaced a distance A from said axis of rotation of said eccentric stud, said axis of rotation of said eccentric stud being located spaced said distance A from said axis of rotation of said rotatably drivable housing; adjusting means for rotating said eccentric stud around said eccentric stud axis of rotation through an angle, said adjustment means being operated from outside of said rotatably drivable housing for moving said central axis of said eccentric pin within a range of adjustment including one extreme position in which said central axis of said eccentric pin coincide with said rotatably drivable housing axis and another extreme position in which said central axis of said eccentric pin is located at a maximum distance from said rotatable drivable housing axis; and means for transmitting reciprocating movement of said eccentric pin to the distributing rollers.

2. A device according to claim 1, wherein said adjusting means includes a sleeve mounted coaxially rotatably on said rotatably drivable housing, said sleeve including interior teeth which engage a planetary gear rotatably fixably mounted in said rotatably drivable housing, said planetary gear engaging teeth provided on said eccentric stud.

3. A device according to claim 2, wherein said sleeve is provided with helical teeth arranged on an outside of said sleeve, said helical teeth meshing with a gear provided with corresponding helical teeth, said gear being arranged outside of said rotatably drivable housing and having a stationary axis displacable in an axially parallel manner.

4. A device according to claim 3, wherein said gear is provided with helical teeth nonrotatably but axially displacably connected to a spur gear, said spur gear engaging teeth arranged on said rotatably drivable housing for rotation around said axis of rotation of said rotatably drivable housing.

5. A device according to claim 3, wherein said gear provided with helical teeth is displaced by means of a pneumatically displacable piston having a stroke adjustable by means of an adjustable stop.

6. A device according to claim 4, wherein said gear provided with helical teeth is displaced by means of a pneumatically displacable piston having a stroke adjustable by means of an adjustable stop.

7. A device according to claim 1, wherein an eccentric pin is provided at both ends of said eccentric stud, each of said eccentric pins are positioned in the same radial position with respect to the axis of said eccentric stud.

8. A device according to claim 1, further comprising an additional eccentric stud arranged in said rotatably drivable housing, said additional eccentric stud having an eccentric pin located opposite said eccentric pin of said eccentric stud, said eccentric pin of said additional eccentric stud being located a distance B from an axis of said additional eccentric stud and said axis of said additional eccentric stud is located said distance B from said axis of rotation of said rotatably drivable housing.

9. A device according to claim 8, wherein said eccentric pins are offset relative to one another through an angle of 90° and said distance A and said distance B enclose an angle of 90° .

10. A device according to claim 8, wherein teeth are arranged at a central end of each of said eccentric studs and engage a planetary gear.

11. A device according to claim 9, wherein teeth are arranged at a central end of each of said eccentric studs and engage a planetary gear.

12. A device according to claim 7, wherein each of said eccentric studs are supported by outer bearings including conical slide bearing surfaces, said eccentric studs including corresponding cones, said studs being pressed by a centrally arranged spring for urging respective cones into conical slide bearing surfaces.

13. A device according to claim 1, wherein said rotatably drivable housing is rotatably mounted on a printing press with said axis of rotation at right angles to axes of rotation of the distributing rollers, said means for transmitting movement to the distributing rollers include sliding blocks engaged with said eccentric pin.

14. A device according to claim 13, further comprising a driving gear, driven by a printing press drive, non-rotatably arranged on said rotatably drivable housing.

* * * * *